US006207907B1

(12) United States Patent
Gillig et al.

(10) Patent No.: US 6,207,907 B1
(45) Date of Patent: Mar. 27, 2001

(54) KEYPAD WITH INDIVIDUAL KEYS MADE FROM TRANSPARENT PLASTIC

(75) Inventors: Eric Gillig, Hoenheim; Frédéric Rubach, Blaesheim; Roland Spinner, Erstein, all of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/393,460

(22) Filed: Sep. 10, 1999

(30) Foreign Application Priority Data

Sep. 14, 1998 (EP) ..... 98440209

(51) Int. Cl.[7] ..... H01H 9/26
(52) U.S. Cl. ..... 200/5 A; 200/341
(58) Field of Search ..... 200/5 A, 341–344

(56) References Cited

U.S. PATENT DOCUMENTS 4,125,934 * 11/1978 Keough et al. ..... 200/5 R
5,193,669 * 3/1993 Demeo et al. ..... 200/512
5,280,146 * 1/1994 Inagaki et al. ..... 200/341
5,670,759 * 9/1997 Hsu ..... 200/5 A
5,745,566 * 4/1998 Petrella et al. ..... 379/433
5,828,016 * 10/1998 Grannan et al. ..... 200/16 R
5,982,304 * 11/1999 Selker et al. ..... 200/27

FOREIGN PATENT DOCUMENTS 0 163 624 A2 12/1985 (EP) .
0 325 757 A2 8/1989 (EP) .
WO 90/00304 1/1990 (WO) .

* cited by examiner

*Primary Examiner*—Michael L. Gellner
*Assistant Examiner*—Nhung Nguyen
(74) *Attorney, Agent, or Firm*—Sughrue, Mion, Zinn, Macpeak & Seas, PLLC

(57) ABSTRACT

A keypad with individual keys made from transparent plastic is proposed where the individual keys are connected to a guard. The guard has means of fastening the guard and the individual keys to a housing and a label which can be written on can be inserted between the housing and the guard.

11 Claims, 3 Drawing Sheets

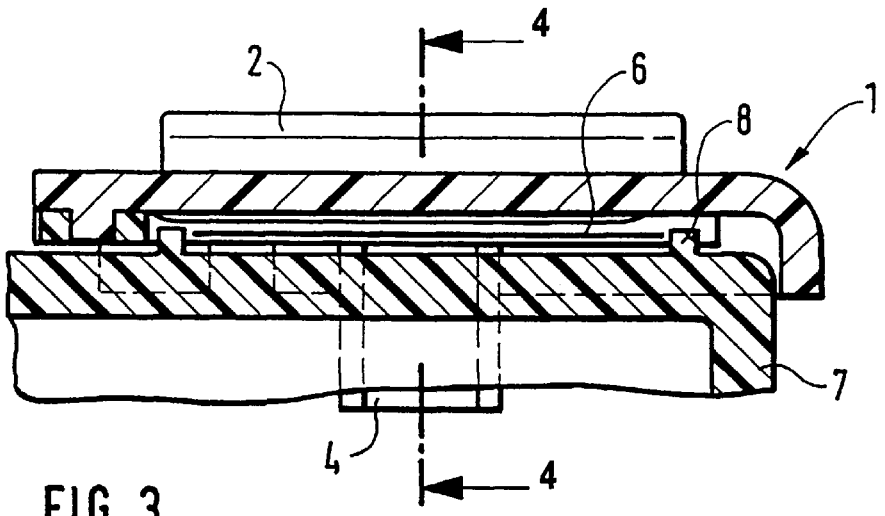
FIG. 3
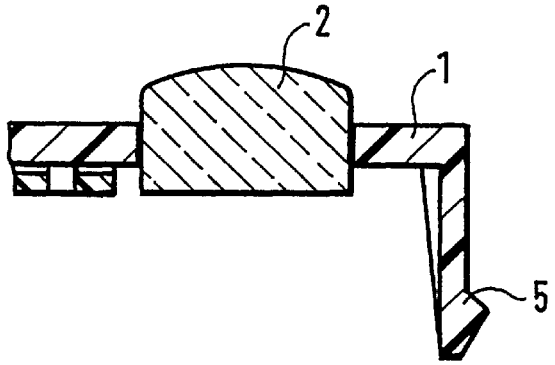
FIG. 4
FIG. 5
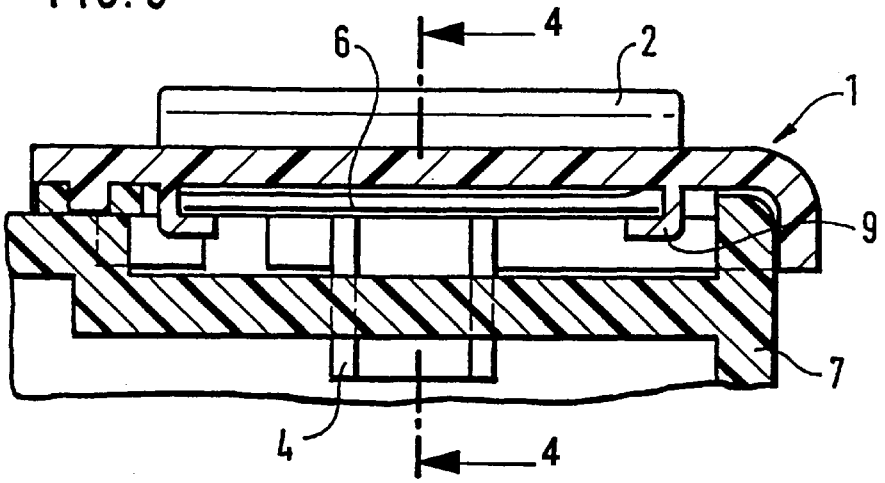

KEYPAD WITH INDIVIDUAL KEYS MADE FROM TRANSPARENT PLASTIC

BACKGROUND OF THE INVENTION

The invention is based on a keypad with individual keys made from transparent plastic. Keypads as used in telephone devices are already known in the art. A conventional telephone terminal contains a keypad part with individual numbers as well as keys which trigger defined functions. These special function keys are, for example, lettered or engraved on the keypad surfaces. In addition, conventional devices have keys whose function is freely programmable. In order to give the user information on the programmed function of the individual key, it is possible to write in a title block adjacent to the key. In order to guarantee the user the most simple use of his terminal, a number of function keys can be used. The number of function keys is limited due to their space requirements, as the freely programmable keys with their adjacent title blocks take up a large proportion of the surface of the device. In addition, conventional devices which contain lettered function keys are always designed for a certain language region. Thus different product lines are necessary to produce lettering in different languages.

SUMMARY OF THE INVENTION

The keypad in accordance with the invention with individual keys made from transparent plastic with the characteristic features of the invention has the advantage that the individual keys are not lettered on the surface but the user can see through to a lettered label. This lettered label lies advantageously below the transparent individual keys so that the space requirement overall is low. The written label can be replaced easily through the fastening means.

Through the measures listed in the subclaims, advantageous additional embodiments and improvements to the keypad given in the main claim are possible. It is particularly advantageous that the transparent individual keys are glued, bonded or fused to a guard using connection points.

The surfaces of the transparent individual keys advantageously have a convex formed surface which magnifies the label below. In addition, the form of the surface is pleasant to use as the individual keys have a pleasant form and size for use. Advantageously, the whole unit comprising guard and individual keys has a snap closure by which the unit can be fastened to a housing. In addition, it is advantageous that the label is inserted between ribs formed in the surface of the housing. In a further embodiment, the label is centred by mountings applied to the guard.

The label itself is advantageously made from paper or foil and can be put together and labelled by the user. It is also possible to highlight the label with colour or patterns, to better differentiate the individual functions. The invention keypad can be advantageously used on telecommunications terminals, such as telephones, fax machines, etc.

BRIEF DESCRIPTION OF THE DRAWINGS

Design examples of the invention are shown in the drawings and are described in more detail in the following description.

The drawings show the following:

FIG. 3 a section with a rib design along line 3—3

FIG. 4 the section along line 4—4

FIG. 5 a section of a mounting design along line 3—3

DETAILED DESCRIPTION OF THE INVENTION

Figure 1:
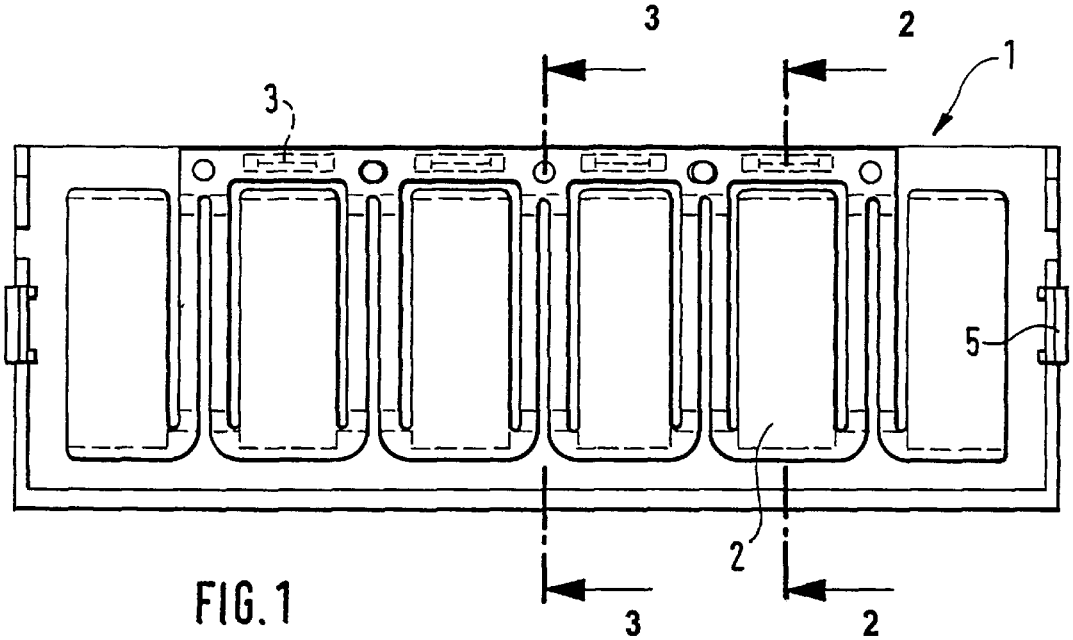
FIG. 1 view of a keypad field

FIG. 1 shows a keypad field with six individual keys. The arrangement of the keys is, in this case, above one another; the keypad field can, however, be structured differently. The field consists of a guard 1 which has openings in the form of transparent individual keys 2. The guard is used to install the individual keys in the housing of the device. Generally, the guard is made from a non-transparent plastic. A means of fastening 5 is applied to the two narrow sides of the guard 1, by means of which the guard can be fastened to the housing. Individual transparent keys 2 are placed within the openings. These individual transparent keys are not manufactured as single parts but, as shown in this example, as individual keys linked to one another, and having the same base. This detail can be better seen in FIG. 6. The individual transparent keys are connected to the guard 1 through connection points 3. The connection can be made using a contact spot, by fusing the two plastic parts or by plastic bonding.

Figure 2:
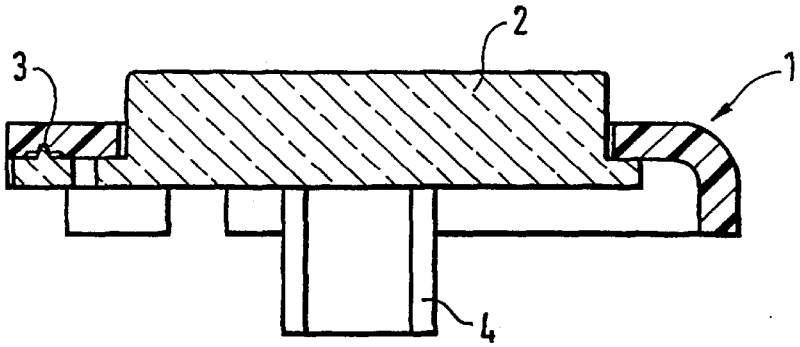
FIG. 2 a section of the keypad along line 2—2

FIG. 2 shows the section through line 2—2. This shows the guard 1 into which the individual key engages. The individual key 2 made from transparent plastic is connected to the guard 1 at the connection point. The lower surface of the individual key 2 sits on the flexible plastic action point 4; this plastic action point 4 can be a part of a flexible plastic keypath which lies on the circuit in the housing or a single button connection.

FIG. 3 shows the individual key 2 in a first embodiment along line 3—3. The guard 1 sits on the housing 7. The housing 7 has ribs 8 to the left and right of the individual key 2. A label 6 is inserted between these ribs 8. The individual key 2 sits on the label. Below the individual key 2, the plastic action point 4 can be seen. In this embodiment, the label 6 lies on the housing itself. The guard 1 with the individual keys 2 can be lifted from the housing and the label can be thus removed or replaced. The rounding of the guard on the right hand side as well as the housing 7 is a specific embodiment and does not represent a technical requirement.

FIG. 4 is a section 4—4 along the individual key 2. The individual key 2 sits in the opening in the guard 1. The fastening device 5 in the form of a snap connection can be seen on the right hand side.

FIG. 5 shows a second embodiment of the keypad in accordance with the invention. The structure of guard, individual key 2 and housing 7 corresponds to that in FIG. 3. The difference from the first embodiment is that the label 6 lies in the mounting 9, where the mounting is connected with the guard 1.

Figure 6:
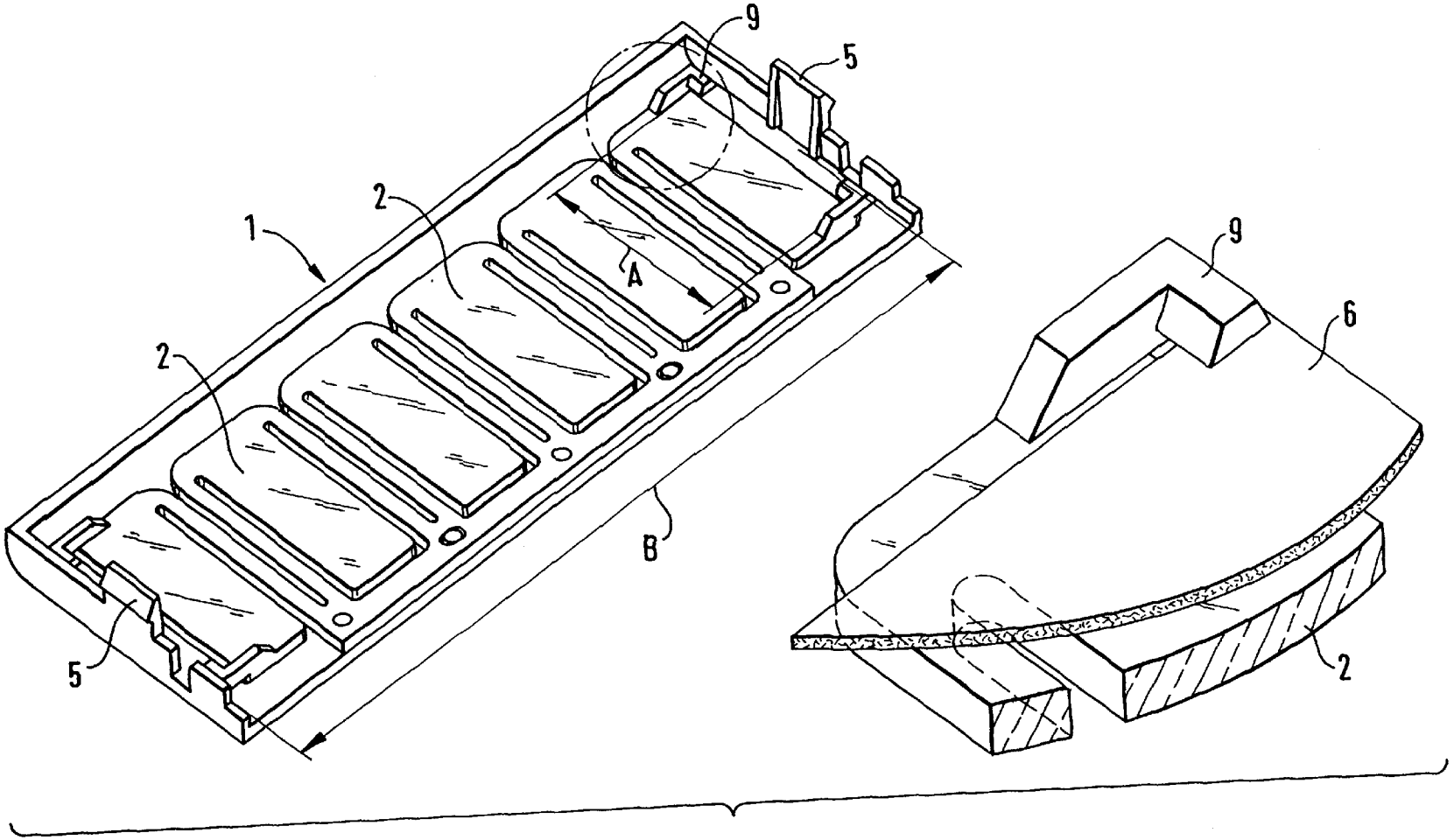
FIG. 6 the view from below of a keypad field with a mounting design and detail.

FIG. 6 shows a view of the embodiment with mountings 9, seen from below towards the individual keys 2 and the guard 1. The label to be inserted is passed within the mountings. This embodiment is particularly advantageous as the user can remove the label 6 with the guard 1 and the individual keys on opening the snap connection 5. He can easily remove and replace the label back into the mounting. The guard can be connected to the housing without the label slipping. The labels can be made in advance for the function keys and printed with different characters, including Chinese characters. Even different colours are possible by using labels. The keys which are individually programmed by the user can be identified by the user by writing on the replaceable labels. The labels consist of strengthened paper or foil which can be written on. The resilience of the labels, on which force is exerted on pressing the keys onto the plastic action point, is generally so great that they can be used up to 10,000 times. The label can be read through the transparent individual keys as the convex shaped surface has a magnifying effect. The size of the keys can be large enough so that the user can operate the keypad in a comfortable manner.

What is claimed is:

1. A keypad, comprising:

a housing;

keys made from a transparent plastic material, each of the keys having a flexible plastic action point;

guard linked to the keys and having a snap closure structure to fasten the guard to the housing; and a label for each of the keys, each label being located between the housing and the guard, wherein, upon activation of at least one of the keys, the at least one of the keys triggers a switching operation in the housing.

2. The keypad of claim 1, wherein the guard is glued to the keys at at least one connection point between the guard and the keys.

3. The keypad of claim 1, wherein the guard is bonded to the keys at at least one connection point between the guard and the keys.

4. The keypad of claim 1, wherein the guard is fused to the keys at at least one connection point between the guard and the keys.

5. The keypad of claim 1, wherein each of the keys has a convex shaped surface.

6. The keypad of claim 1, wherein the label is centered between ribs of the housing.

7. The keypad of claim 1, wherein the label is centered between mountings formed on the guard.

8. The keypad of claim 1, wherein the label comprises a material selected from the group consisting of paper and foil.

9. The keypad of claim 1, wherein the label comprises a colored label.

10. The keypad of claim 1, wherein the label comprises a patterned label.

11. The keypad of claim 1, wherein the keypad is mounted in a telecommunications terminal.

* * * * *